US011259672B1

(12) United States Patent
Henry

(10) Patent No.: US 11,259,672 B1
(45) Date of Patent: Mar. 1, 2022

(54) AFTER SHOWER DRYING SYSTEM

(71) Applicant: Lenell Henry, Vicksburg, MS (US)

(72) Inventor: Lenell Henry, Vicksburg, MS (US)

( * ) Notice: Subject to any disclaimer, the term of this patent is extended or adjusted under 35 U.S.C. 154(b) by 107 days.

(21) Appl. No.: 16/885,539

(22) Filed: May 28, 2020

(51) Int. Cl.
*A47K 10/48* (2006.01)

(52) U.S. Cl.
CPC ..... *A47K 10/48* (2013.01)

(58) Field of Classification Search
CPC ..... A47K 10/48
See application file for complete search history.

(56) References Cited

U.S. PATENT DOCUMENTS

| | | | | |
|---|---|---|---|---|
| 5,930,912 | A | 8/1999 | Carder | |
| 6,148,539 | A | 11/2000 | Hatfield et al. | |
| 6,349,484 | B1 | 2/2002 | Cohen | |
| D492,072 | S | 6/2004 | Vaajakallio | |
| 6,962,005 | B1 | 11/2005 | Khosropour et al. | |
| 7,900,371 | B1 * | 3/2011 | Bullard | A47K 10/48 34/202 |
| 8,112,899 | B1 * | 2/2012 | Duckworth | A47K 10/48 34/202 |
| 9,615,702 | B2 * | 4/2017 | Calpe Gargallo | A47K 10/48 |
| 2013/0025149 | A1 * | 1/2013 | Farousi | A47K 10/48 34/88 |

OTHER PUBLICATIONS

Valiryo. Body Dryer Bathroom. Product Listing [online]. Buscamos Distribuidores [retrieved on Apr. 11, 2019]. Retrieved from the Internet: <URL: https://www.tutiendadecoracion.com/Valiryo-Body-Dryer-Bathroom>.

Tornado Body Dryer—Electric Full-Body In-Shower Hands-Free Drying Unit. Product Listing [online]. © 1996-2020, Amazon.com, Inc. [retrieved on Nov. 13, 2019]. Retrieved from the Internet: <URL: hhttps://www.amazon.com/Tornado-Body-Dryer-Shower-Electric/dp/B00AR0050I>.

* cited by examiner

*Primary Examiner* — Janie M Loeppke
(74) *Attorney, Agent, or Firm* — Cramer Patent & Design, PLLC; Aaron R. Cramer

(57) ABSTRACT

An after-shower drying system is fashioned as an arched-shaped device having a plurality of air-drying assemblies and at least one (1) handle disposed along an interior face of the device. The arch is sized sufficiently to permit a human being to walk beneath the arch. Each blower is movable. The outside face of the device comprises a plurality of suction cups.

20 Claims, 5 Drawing Sheets

AFTER SHOWER DRYING SYSTEM

FIELD OF THE INVENTION

The presently disclosed subject matter is directed to a dryer and more specifically to an after shower drying system.

BACKGROUND OF THE INVENTION

A part of just about everyone's daily ritual is that of bathing. Whether done in a bath or shower, drying oneself off with a towel is an integral part of such an activity. However, after several uses, these towels must be washed and dried themselves, so as to keep fresh smelling. This washing and drying process then uses more water, detergent, energy and importantly time in our already busy week.

Additionally, while drying off may only take a minute or two, these minutes are very valuable when trying to get ready for work, school or other activities. People must also fix their hair, brush their teeth, shave and the like as part of their bathing activity. Finally, those who may be elderly, physically disabled, recovering from surgery or the like, may find the process of drying themselves with a towel difficult or impossible. Accordingly, there exists a need for a means by which drying after a bath or shower can be accomplished without the disadvantages as described above. The development of the body drying device for showers fulfills this need.

SUMMARY OF THE INVENTION

The principles of the present invention provide for a body drying device, comprises a frame having a pair of parallel sides with each connected by an arched top, an electrical power source which provides a plurality of electrical power to the body drying device, a plurality of ambient room air drawn into the body drying device through a plurality of vents which are located at a bottom of each of the pair of parallel sides into a first plenum area and a fan mechanism which receives and places the ambient room air in the first plenum area under pressurization to move through the body drying device into a second plenum area where it exits through a resistance heating mechanism. The ambient room air then exits into an output header extending up through the arched top and is exhausted through the exhaust ports. The output header includes a duct connection to a socket connection.

The body drying device also comprises a plurality of conditioned air exhausted from a plurality of exhaust ports. The exhaust ports may be manipulated by hand to direct the conditioned air along a semispherical travel path. The body drying device also comprises a plurality of lockable sliding suction cups which are provided on an exterior of the body drying device to hold the body drying device stationary while in use, a pair of handles which are provided to afford a user of the body drying device physical posture stability during use, a power switch, a timer control, and a temperature/speed control panel which provide electrical control of the body drying device and a movable ball connection frictionally fitting into the socket connection where with a nozzle is moved along the semispherical travel path. The conditioned air then exits the nozzle along an axial path in alignment with a centerline of the nozzle. The body drying device also may comprise a shower enclosure which includes a shower head and a water controlling means.

The electrical power source is a plurality of AC power provided by an AC power cord connected to a ground fault circuit breaker protected outlet. The electrical power source may be a plurality of DC power provided by a DC battery connected by a DC power cord. The DC power may be converted to AC by use of a DC to AC inverter. The fan mechanism may be powered by a variable speed electrical motor. The conditioned air may be under pressure and may be heated. The lockable sliding suction cups may be attached to a slide/lock mechanism allowing the lockable sliding suction cups to move in and out along a suction cup travel path. The body drying device may be portable. The body drying device may be seven feet high and may have an interior opening of three feet.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
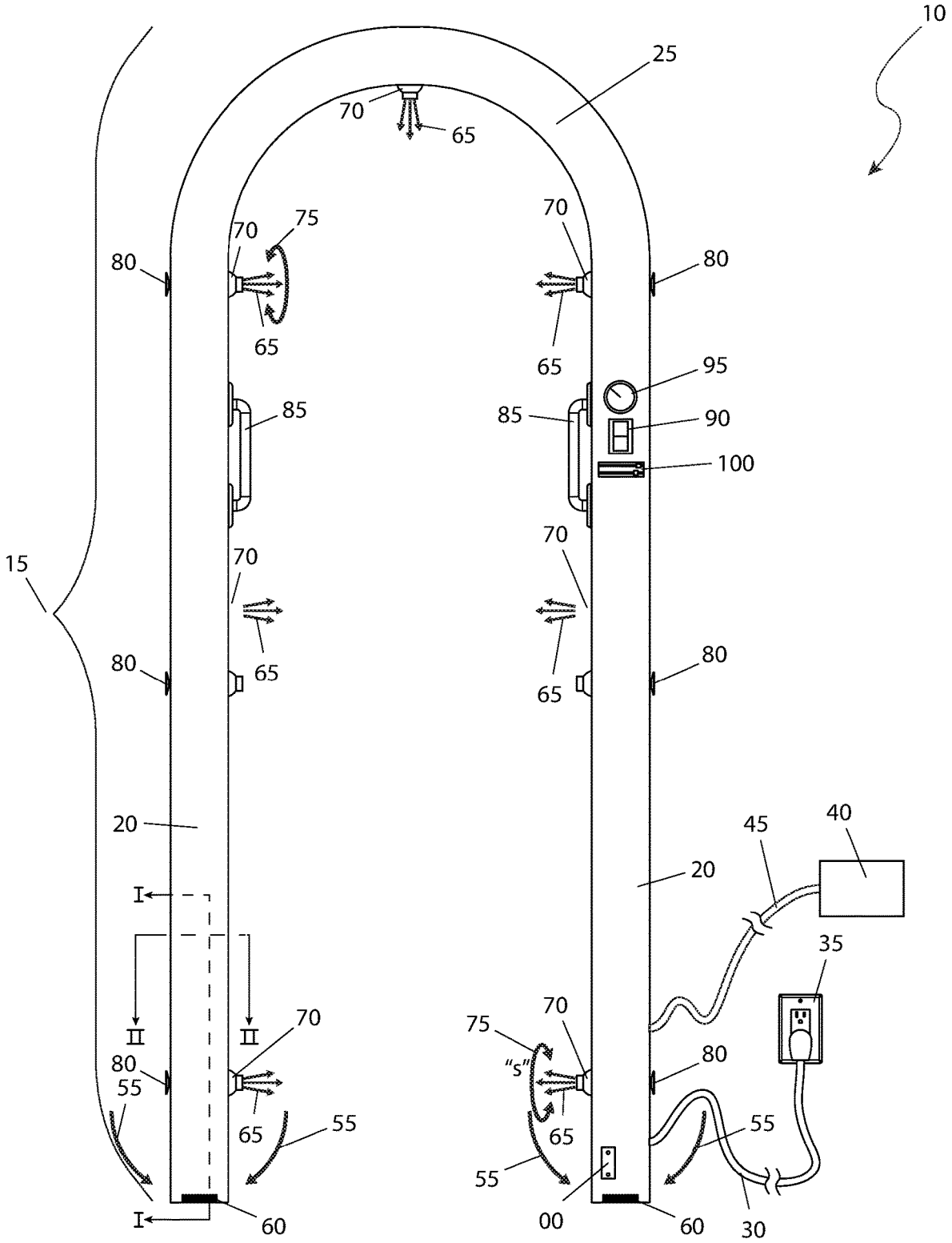
FIG. 1 is a front view of the body drying device 10, according to the preferred embodiment of the present invention.

10 body drying device
15 frame
20 parallel side
25 arched top
30 AC power cord
35 ground fault circuit breaker protected outlet
40 DC battery
45 DC power cord
50 DC to AC inverter
55 room air
60 vents
65 conditioned air
70 exhaust port
75 semispherical travel path "s"
80 lockable sliding suction cup
85 handle
90 power switch
95 timer control
100 temperature/speed control panel
105 first plenum area
110 fan mechanism
115 variable speed electrical motor
120 pressurized air
125 second plenum area
130 resistance heating mechanism
135 output header

140 duct connection
145 socket connection
150 movable ball connection
155 nozzle
160 slide/lock mechanism
135 suction cup travel path "l"
170 shower enclosure
175 shower head
180 water controlling means
185 wall area
190 automatic transfer switch
195 motor drive circuit
200 heater control circuit

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the body drying device 10, according to the preferred embodiment of the present invention is disclosed. The body drying device 10 (herein also described as the "device") 10, allows drying of a user's body after a shower without the use of a towel and includes a frame 15 made of two (2) parallel sides 20 connected by an arched top 25. While the exact dimensions and configuration of the device 10 is not intended to be a limiting factor of the present invention, it is envisioned that a typical configuration would have an overall height of approximately seven feet (7 ft.) with an interior opening width of approximately three feet (3 ft.).

The device 10 is electrically powered from one (1) of two (2) dual sources. AC power is provided by an AC power cord 30 connected to a ground fault circuit breaker protected outlet 35, or by a DC battery 40 connected by a DC power cord 45. The DC power is converted to AC by use of a DC to AC inverter 50. Ambient room air 55 is drawn into the device 10 through vents 60 located at the bottom of each of the parallel sides 20. Conditioned air 65, which is under pressure and may be heated, is then exhausted from a set of exhaust ports 70. In a preferred embodiment, there are seven (7) exhaust ports 70; three (3) exhaust ports 70 are located on each parallel side 20 facing inward, while one (1) exhaust port 70 is mounted on the arched top 25 facing downward. These exhaust ports 70 are able to be manipulated by hand to aim the produced conditioned air 65 along a semispherical travel path "s" 75 as depicted. Such an arrangement allows for ease of use of the device 10 by users of all sizes including adults and children. The device 10 is portable in nature and may be moved about as needed. To hold stationary while in use, a series of six (6) lockable sliding suction cups 80 (three (3) per each parallel side 20) are provided on the exterior of the device 10. Further explanation of the lockable sliding suction cups 80 will be provided herein below. Two (2) handles 85 (one (1) per each interior parallel side 20) are provided to afford the user of the device 10 physical posture stability during use. Electrical control of the device 10 is provided by a power switch 90, a timer control 95 and a temperature/speed control panel 100. Further disclosure of the functionality and operating characteristics of the electrical components of the device 10 will be provided herein below.

Figure 2:
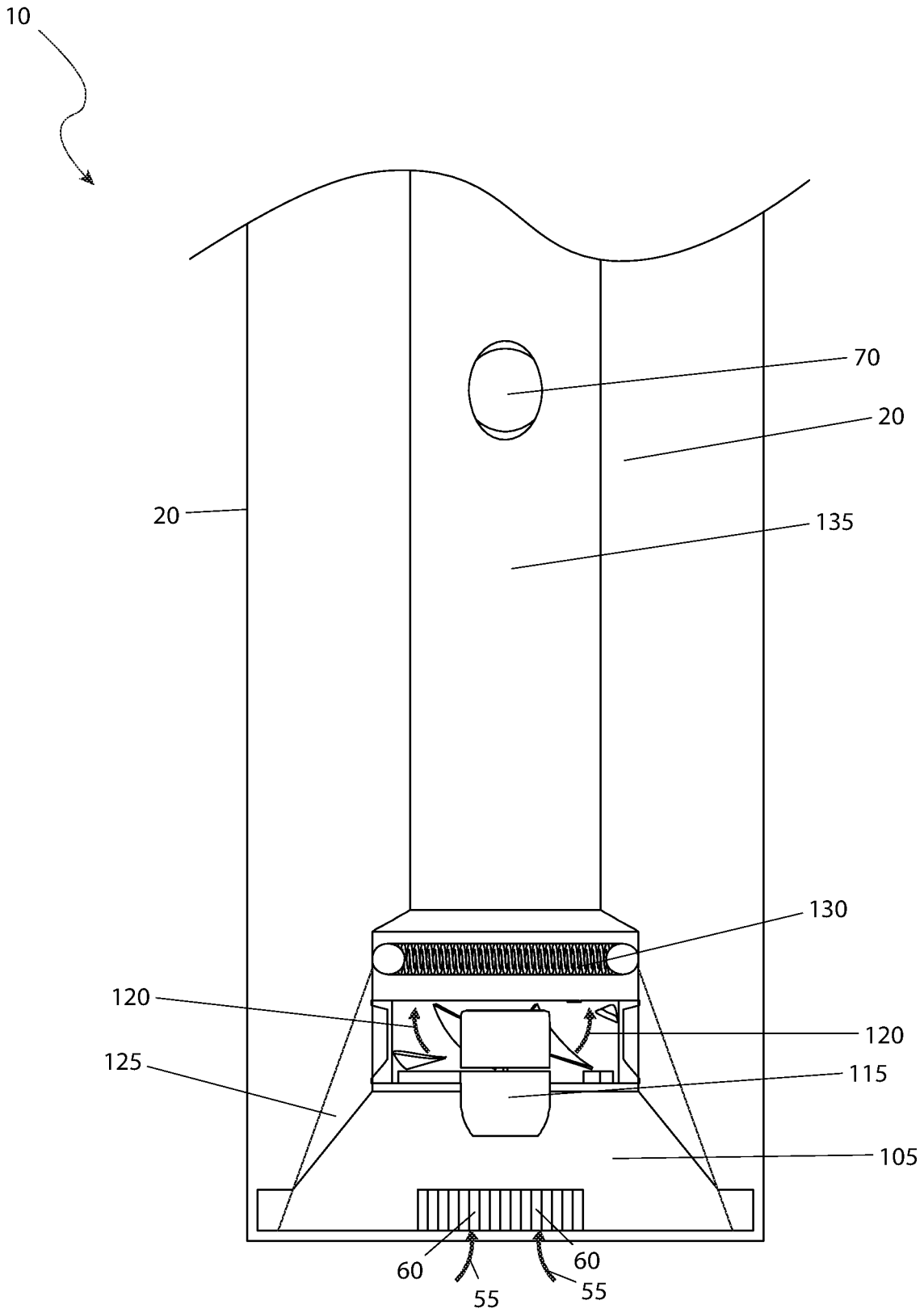
FIG. 2 is a sectional view of the body drying device 10, as seen along a line I-I, as shown in FIG. 1, according to the preferred embodiment of the present invention.

Referring next to FIG. 2, a sectional view of the device 10, as seen along a line I-I, as shown in FIG. 1, according to the preferred embodiment of the present invention is depicted. As aforementioned described, room air 55 enters through the vents 60 and enters a first plenum area 105. Room air 55 then passes through a fan mechanism 110, powered by a variable speed electrical motor 115 whereupon it is placed under pressurization to move through the balance of the device 10. The resultant pressurized air 120 then enters a second plenum area 125 where it exits through a resistance heating mechanism 130, whereupon it may or may not be heated depending upon the position of the temperature/speed control panel 100 (as shown in FIG. 1). The air flow then exits into an output header 135 which extends up through the arched top 25 (as shown in FIG. 1) and is exhausted through the seven (7) exhaust ports 70 (of which only two (2) are visible in FIG. 2). It is noted that the arrangement as shown in FIG. 2 for one (1) of the two (2) parallel sides 20 is generally duplicated in the opposite parallel side 20 as well.

Figure 3:
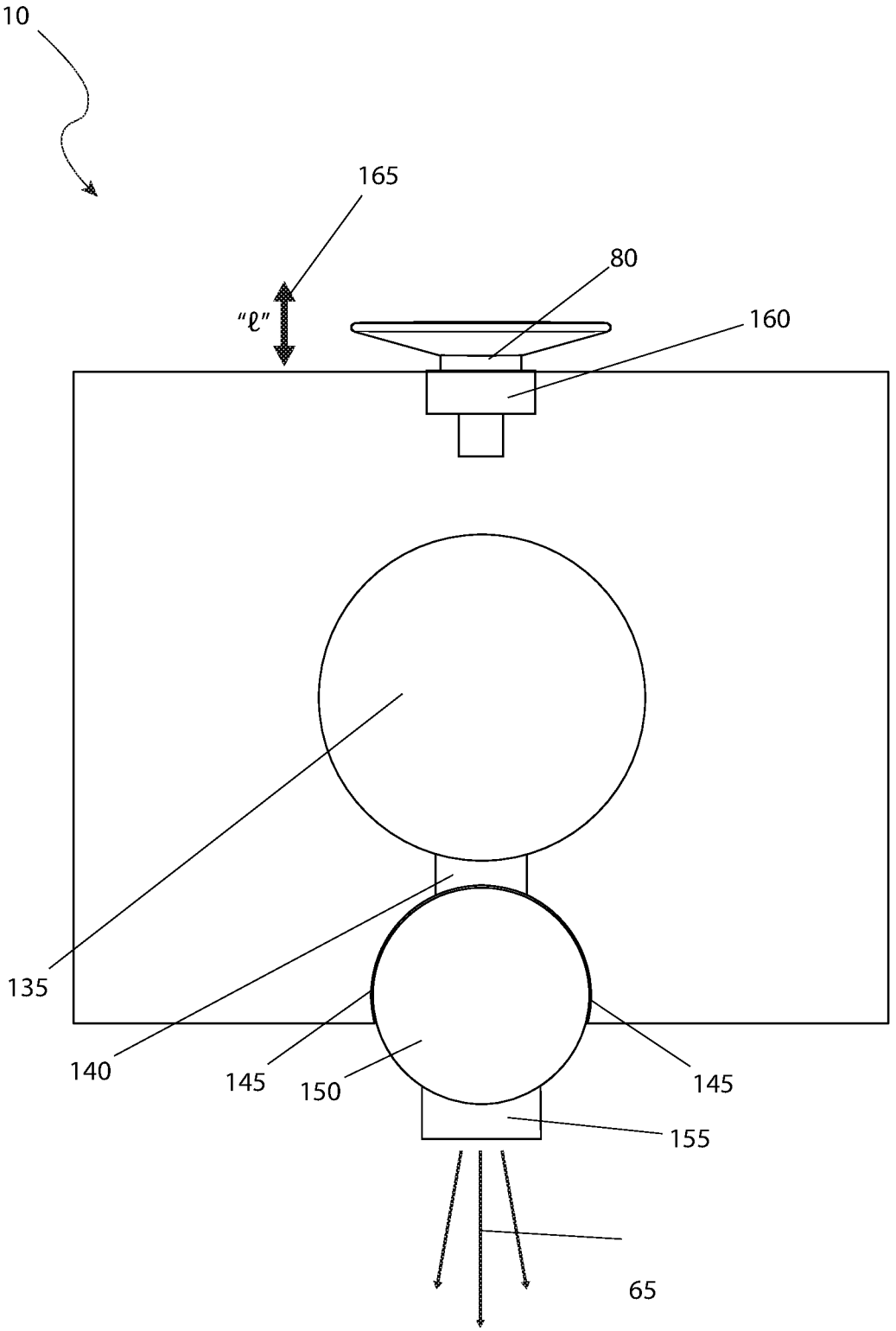
FIG. 3 is a sectional view of the body drying device 10, as seen along a line II-II, as shown in FIG. 1, according to the preferred embodiment of the present invention.

Referring now to FIG. 3, a sectional view of the device 10, as seen along a line II-II, as shown in FIG. 1, according to the preferred embodiment of the present invention is shown. This view provides clarification on the internal arrangement of the parallel sides 20 and is generally similar at any point along most points of the parallel sides 20 or the arched top 25 (as shown in FIG. 1). The output header 135 is generally located in the middle, with a duct connection 140 to a socket connection 145. A movable ball connection 150 then frictionally fits into the socket connection 145 where it along with a nozzle 155 may be moved along the semispherical travel path "s" 75 (as shown in FIG. 1). The conditioned air 65 then exits the nozzle 155 along an axial path in general alignment with the centerline of the nozzle 155. The lockable sliding suction cups 80 is attached to a slide/lock mechanism 160 allowing the lockable sliding suction cups 80 to move in and out along a suction cup travel path "l" 165.

Figure 4:
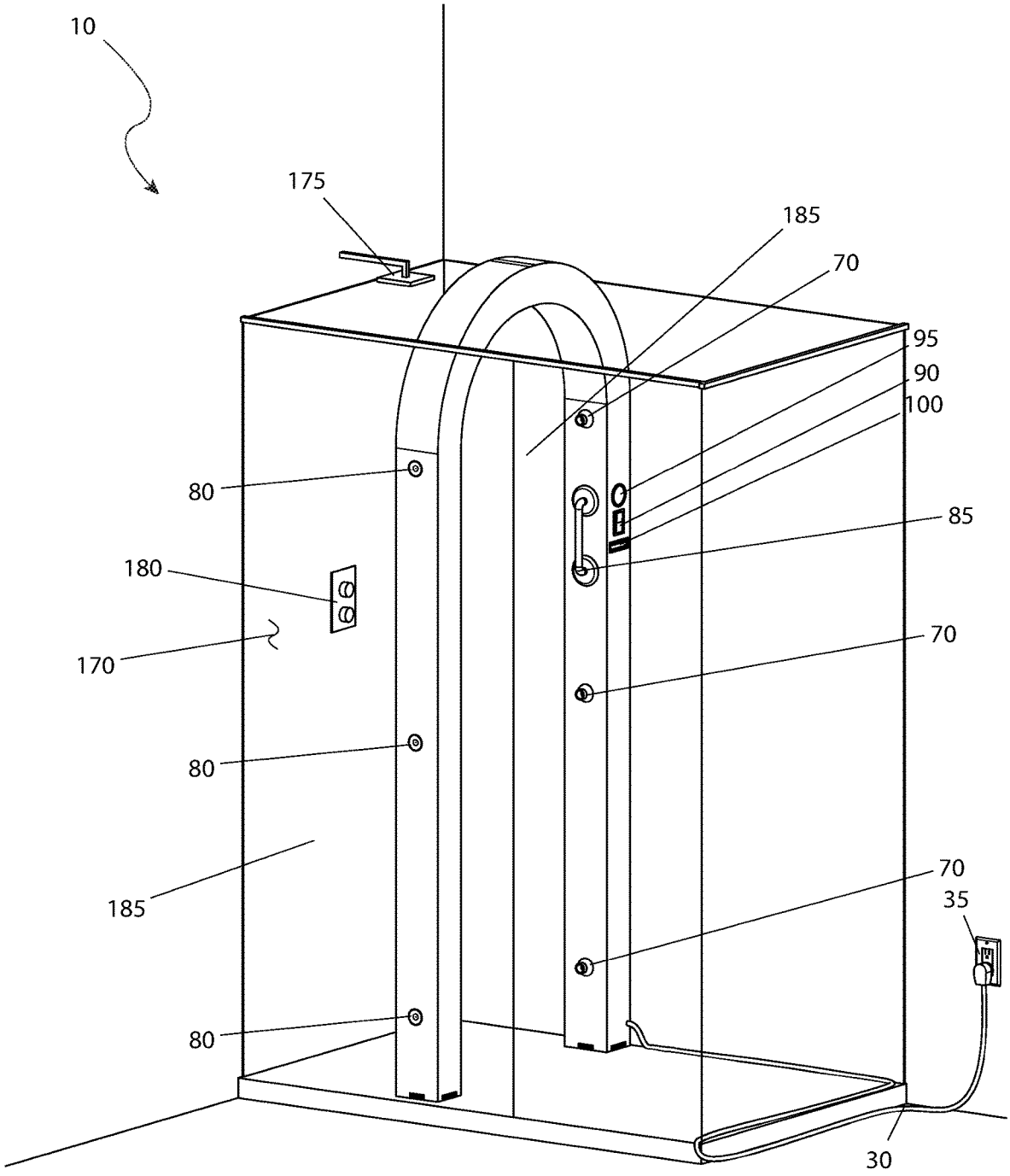
FIG. 4 is a perspective view of the body drying device 10, shown in an installed state in a shower enclosure 170, according to the preferred embodiment of the present invention; and, FIG. 5 is an electrical block diagram of the body drying device 10, according to the preferred embodiment of the present invention.

Referring next to FIG. 4, a perspective view of the device 10, shown in an installed state in a shower enclosure 170, according to the preferred embodiment of the present invention is disclosed. The shower enclosure 170 is general in nature and is envisioned to provide a shower head 175 and water controlling means 180 at a minimum. The device 10 is located out of the direct water flow from the shower head 175, but within the shower head 175 to help contain shed water. It is noted however, that the device 10 may be used adjacent to the shower enclosure 170 as well depending on the physical size of the shower enclosure 170. The lockable sliding suction cups 80 are engaged on each side of the device 10 to secure to the wall areas 185. Thus, after the user completes the showering process, the water flow is turned off, and the user steps within the center area of the device 10. The device 10 is connected via the AC power cord 30 to a ground fault circuit breaker protected outlet 35 as it is readily available. In cases where a ground fault circuit breaker protected outlet 35 is not adjacent to a shower enclosure 170, the device 10 would use the DC battery 40, the DC power cord 45, and the DC to AC inverter 50 (all of which are shown in FIG. 1) for operation. The user would select the desired air speed and temperature via the temperature/speed control panel 100, along with operating time via the power switch 90 and the timer control 95. The user would hold onto the handles 85 during the drying process, utilizing the exhaust ports 70. When complete, the user simply steps out of the shower enclosure 170 in a completely dry state.

Figure 5:
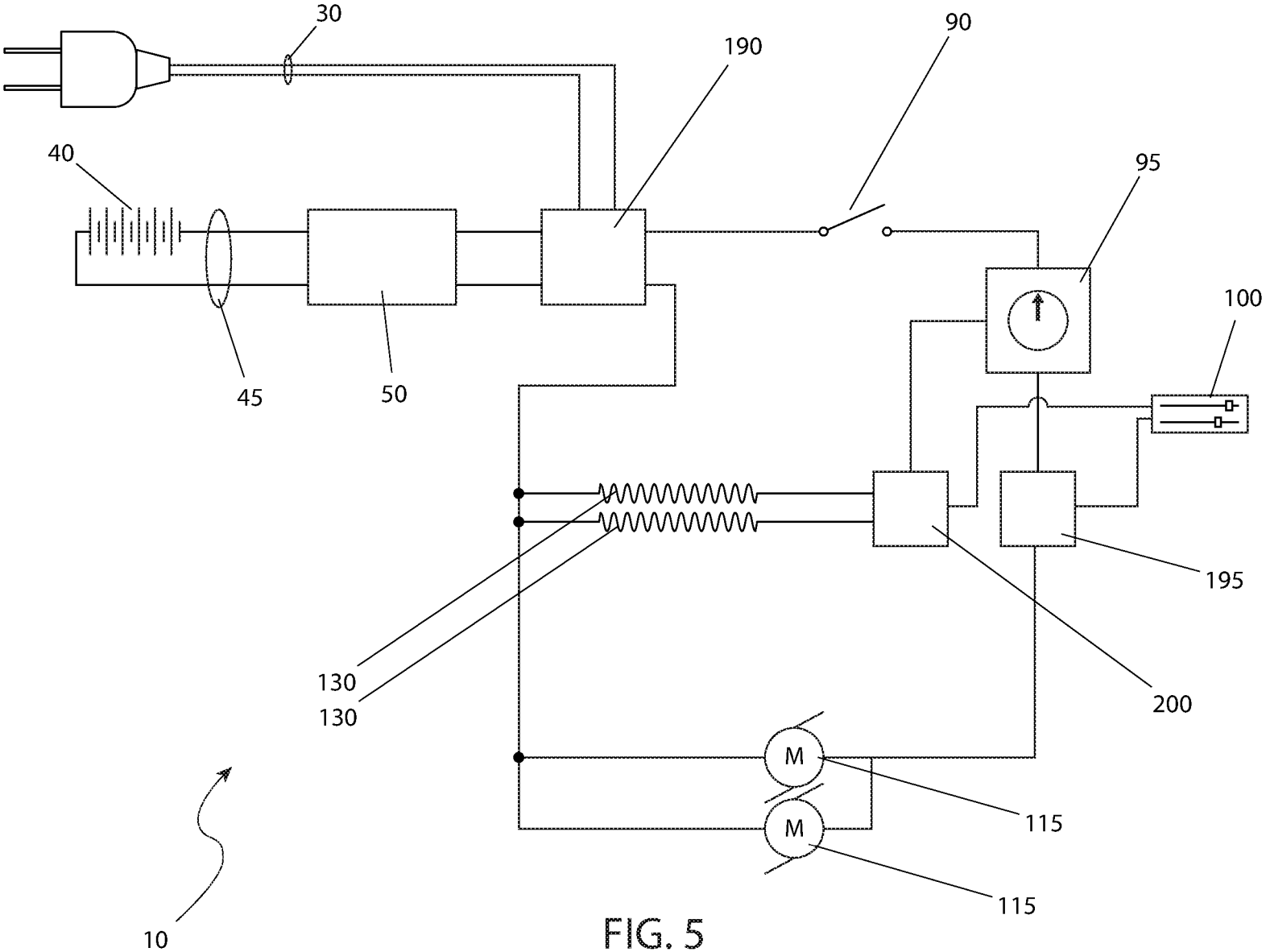

Referring finally to FIG. 5, an electrical block diagram of the device 10, according to the preferred embodiment of the present invention is depicted. AC power is derived from the AC power cord 30. DC power is obtained from a connected DC battery 40 via the DC power cord 45 and routed though the DC to AC inverter 50 to obtain AC voltage. An automatic transfer switch 190 then either selects the power from the AC power cord 30 as a primary source, or the power from the DC to AC inverter 50 as a secondary source. Resultant power is then routed through the power switch 90 for main control and onto the timer control 95 to prevent the device 10 from continuous unattended operation. Output power from the timer control 95 is then routed in a parallel manner to a motor drive circuit 195 and a heater control circuit 200. These devices also receive control signals from the temperature/speed control panel 100. Output power is the routed to the two (2) 115 and the two (2) resistance heating mechanisms 130 respectively.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as home improvement stores, mechanical supply houses, mail order and internet supply houses and the like. Special attention would be paid to the overall size of the device 10, style, color, operating controls, and the like.

After procurement and prior to utilization, the device 10 would be prepared in the following manner: the device 10 would be located near or in a shower enclosure 170 as shown in FIG. 4. It would be electrically connected to a ground fault circuit breaker protected outlet 35 or a DC battery 40 via the AC power cord 30 or the DC power cord 45 respectively. At this point in time, the device 10 is ready for operation.

During utilization of the device 10, the following procedure would be initiated: after completion of a shower, the user would select air speed and air temperature via the temperature/speed control panel 100, drying time via the timer control 95 and then energize the device 10 via the power switch 90; user then steps within the confines of the device 10 as bordered by the frame 15 of the device 10; adjust the conditioned air 65 from the exhaust ports 70 via manual manipulation of the nozzle 155 to suit the size and/or preferences of the user; hold the handles 85 on each parallel side 20; until the drying process is complete; user exits the frame 15 of the device 10 in a dry state whereupon the device 10 remains until needed again by the same user or different user in a continuous, cyclical process.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A body drying device, comprising:

a frame having a pair of parallel sides connected by an arched top;

an electrical power source providing electrical power to the body drying device;

a volume of ambient room air drawn into the body drying device through a plurality of vents located at a bottom of each of the pair of parallel sides into a first plenum area;

a fan mechanism receiving and placing the ambient room air in the first plenum area under pressurization to move through the body drying device into a second plenum area where it exits through a resistance heating mechanism, wherein the ambient room air exits into an output header extending up through the arched top and is exhausted through a plurality of exhaust ports, the output header includes a duct connection to a socket connection;

a volume of conditioned air exhausted from the exhaust ports, wherein the exhaust ports are manipulated by hand to direct the conditioned air along a semispherical travel path;

a plurality of lockable sliding suction cups provided on an exterior of the body drying device to hold the body drying device stationary while in use;

a pair of handles provided to afford a user of the body drying device physical posture stability during use;

a power switch, a timer control, and a temperature/speed control panel providing electrical control of the body drying device; and wherein the exhaust ports each comprise a movable ball connection frictionally fitting into the socket connections and a nozzle configured to move along the semispherical travel path; wherein the conditioned air exits the nozzle along an axial path in alignment with a centerline of the nozzle.

2. The body drying device according to claim 1, wherein the electrical power source is AC power provided by an AC power cord connected to a ground fault circuit breaker protected outlet.

3. The body drying device according to claim 1, wherein the electrical power source is DC power provided by a DC battery connected by a DC power cord.

4. The body drying device according to claim 3, wherein the DC power is converted to AC by use of a DC to AC inverter.

5. The body drying device according to claim 1, wherein the fan mechanism is powered by a variable speed electrical motor.

6. The body drying device according to claim 1, wherein the conditioned air is under pressure.

7. The body drying device according to claim 1, wherein the conditioned air is heated.

8. The body drying device according to claim 1, wherein the lockable sliding suction cups are attached to a slide/lock mechanism allowing the lockable sliding suction cups to move in and out along a suction cup travel path.

9. The body drying device according to claim 1, wherein the body drying device is portable.

10. The body drying device according to claim 1, wherein the body drying device is 7 feet high and has an interior opening of three feet.

11. A body drying device installed in a shower enclosure, comprising:

a frame having a pair of parallel sides connected by an arched top;

an electrical power source providing electrical power to the body drying device;

a volume of ambient room air drawn into the body drying device through a plurality of vents located at a bottom of each of the pair of parallel sides into a first plenum area;

a fan mechanism receiving and placing the ambient room air in the first plenum area under pressurization to move through the body drying device into a second plenum area where it exits through a resistance heating mechanism, wherein the ambient room air exits into an output header extending up through the arched top and is exhausted through a plurality of exhaust ports, the output header includes a plurality of duct connections to a plurality of socket connections;

a volume of conditioned air exhausted from the exhaust ports, wherein the exhaust ports are manipulated by hand to direct the conditioned air along a semispherical travel path;

a plurality of lockable sliding suction cups provided on an exterior of the body drying device to hold the body drying device stationary while in use;

a pair of handles provided to afford a user of the body drying device physical posture stability during use;

a power switch, a timer control, and a temperature/speed control panel providing electrical control of the body drying device; and wherein the exhaust ports each comprise a movable ball connection frictionally fitting into the socket connections and a nozzle configured to move along the semispherical travel path; wherein the conditioned air exits the nozzle along an axial path in alignment with a centerline of the nozzle; and wherein the shower enclosure includes a shower head and a water controller.

12. The body drying device according to claim 11, wherein the electrical power source is AC power provided by an AC power cord connected to a ground fault circuit breaker protected outlet.

13. The body drying device according to claim 11, wherein the electrical power source is DC power provided by a DC battery connected by a DC power cord.

14. The body drying device according to claim 13, wherein the DC power is converted to AC by use of a DC to AC inverter.

15. The body drying device according to claim 11, wherein the fan mechanism is powered by a variable speed electrical motor.

16. The body drying device according to claim 11, wherein the conditioned air is under pressure.

17. The body drying device according to claim 11, wherein the conditioned air is heated.

18. The body drying device according to claim 11, wherein the lockable sliding suction cups are attached to a slide/lock mechanism allowing the lockable sliding suction cups to move in and out along a suction cup travel path.

19. The body drying device according to claim 11, wherein the body drying device is portable.

20. The body drying device according to claim 11, wherein the body drying device is 7 feet high and has an interior opening of three feet.

* * * * *